United States Patent [19]

Masek et al.

[11] 4,225,284

[45] Sep. 30, 1980

[54] SAFETY SYSTEM FOR A STEAM TURBINE INSTALLATION

[75] Inventors: Jaroslav Masek, Wettingen; Franz Suter, Gebenstorf, both of Switzerland

[73] Assignee: BBC Brown Boveri & Company Limited, Baden, Switzerland

[21] Appl. No.: 909,051

[22] Filed: May 24, 1978

[30] Foreign Application Priority Data

Jun. 8, 1977 [CH] Switzerland ..... 7035/77

[51] Int. Cl.[2] ..... F01D 21/20

[52] U.S. Cl. ..... 415/16; 415/17

[58] Field of Search ..... 415/16, 17, 29, 36, 415/42, 43; 137/58

[56] References Cited

U.S. PATENT DOCUMENTS

| | | | |
|---|---|---|---|
| 2,009,419 | 7/1935 | Schwendner | 415/29 |
| 2,617,438 | 11/1952 | Doran | 415/16 |
| 2,866,470 | 12/1958 | Hold et al. | 415/16 |
| 2,998,017 | 8/1961 | Cavalieri | 415/16 |

*Primary Examiner*—Louis J. Casoregola

*Attorney, Agent, or Firm*—Burns, Doane, Swecker & Mathis

[57] ABSTRACT

A safety system for a steam turbine installation is disclosed based on a closed circuit principle and includes a two-channel low-pressure section in which safety devices are utilized and a high pressure section. Each channel of the low-pressure section acts hydraulically on the high pressure section by way of a tripping and reset relay. The high pressure section includes a high pressure hydraulic system and is divided into an intermediate safety system and a principal safety system each having a two channel arrangement. A one-channel common safety system is provided with stop valves for the steam turbine. Feed and discharge amplifiers are hydraulically connected in series and separate the intermediate and principal safety systems. A separating relay is provided between the principal and intermediate safety system so that the safety devices in the low pressure section can be tested channel by channel during operation of the steam turbine with the series arrangement of the feed and discharge amplifiers being interrupted.

14 Claims, 4 Drawing Figures

SAFETY SYSTEM FOR A STEAM TURBINE INSTALLATION

BACKGROUND AND SUMMARY OF THE PRESENT INVENTION

The invention relates generally to a safety system for a steam turbine installation. The safety system is based on the closed-circuit principle and includes a two-channel low-pressure section, in which safety devices are incorporated, and a high-pressure section.

Safety systems based on the closed-circuit principle are known in the field of control systems for turbines. Furthermore, the normal control system of a turbine functionally falls into two parts, namely the control system itself and the safety system. The safety system is intended as a second line of protection against unacceptable operating conditions, such as overspeed, loss of vacuum, etc. As its most important components, the safety system includes main stop valves, which are usually high-speed stop valves, that shut off all supply of steam to the turbine in the event of disturbances.

A known safety system includes a two-channel, low-pressure section, having an emergency oil system provided with safety devices, and a high-pressure section which is either an oil system or a control-fluid system. The emergency oil system is in the form of a primary system in the sense that in the event of disturbances the oil system is directly de-pressurized by various safety devices. The oil system operates with low-pressure lubricating oil and is divided into two parallel channels, because the safety devices connected to the oil system must be tested while the steam turbine installation is in service. During testing, one of the channels is disconnected from the oil supply and the turbine continues to be protected by the devices in the channel not being tested, since the safety devices are duplicated.

The high-pressure section has a single-channel configuration and includes, among other things, a number of de-pressurizing relays. Hence, the high-pressure section operates solely on the discharge-control principle. With a configuration of this kind the functioning of the relays cannot be checked while the steam turbine installation is in service since the safety system has to be operational by way of the single channel. Furthermore, with a pure discharge control there is a continuous supply of operating medium, and therefore the pressure cannot drop abruptly to zero when required.

An object of the present invention is to create a safety system in which all of the components involved, apart from the unavoidable manual trip, which normally acts simultaneously on both channels of the low-pressure system, can be tested during service with respect to their operational status.

In the present invention, a safety system based on the closed circuit principle and having a two-channel low-pressure section provided with safety devices and a high-pressure section has each channel of the low-pressure section acting hydraulically on the high-pressure section by way of a tripping and reset relay. The high-pressure section is supplied by way of a high-pressure hydraulic system and is divided into an intermediate safety system and a principal safety system, both of which have a two-channel configuration. The high-pressure section is further arranged into a one-channel common safety system via which the stop valves of the steam turbine installation are actuated. Feed and discharge amplifiers are connected in series hydraulically with respect to their supply and separate the intermediate safety system from the principal safety system. A separating relay is located between the principal safety system and the common safety system in such a way that the safety devices in the low-pressure section can be tested channel by channel while the steam turbine installation is in operation. During testing the series arrangement of the feed and discharge amplifiers is interrupted.

An advantage of the present invention is to be seen particularly in the fact that an almost completely safe system can be constructed at a relatively small cost. The series arrangement of the feed and discharge amplifiers causes the operating pressure in the system to fall abruptly and advantageously to zero in the event of a turbine trip.

It is convenient if all of the components of the high-pressure section are contained within a control box. Furthermore, it is desirable to have the feed and discharge amplifiers and the separating relay also contained within a common housing. The first of those arrangements has the advantage especially in the case of steam power plants with boiling water reactors that the entire control box can be situated outside of the "hot zone" (zone of dangerous radiation). Accordingly, the control box is easily accessible. The second arrangement permits an inexpensive, easily maintained construction whereby substantial savings in sealing points and in possible sites of leakage can be achieved.

BRIEF DESCRIPTION OF THE DRAWINGS

A preferred embodiment of the present invention is illustrated in simplified form in the drawings, in which like members bear like reference numerals and wherein.

Parts which are not essential to the invention, such as an electrohydraulic control system that is coupled to the safety system and control valves for the steam turbine, are not illustrated. The flow directions of the various working media are indicated by black arrows.

DETAILED DESCRIPTION OF THE PREFERRED EMBODIMENT

Figure 1:
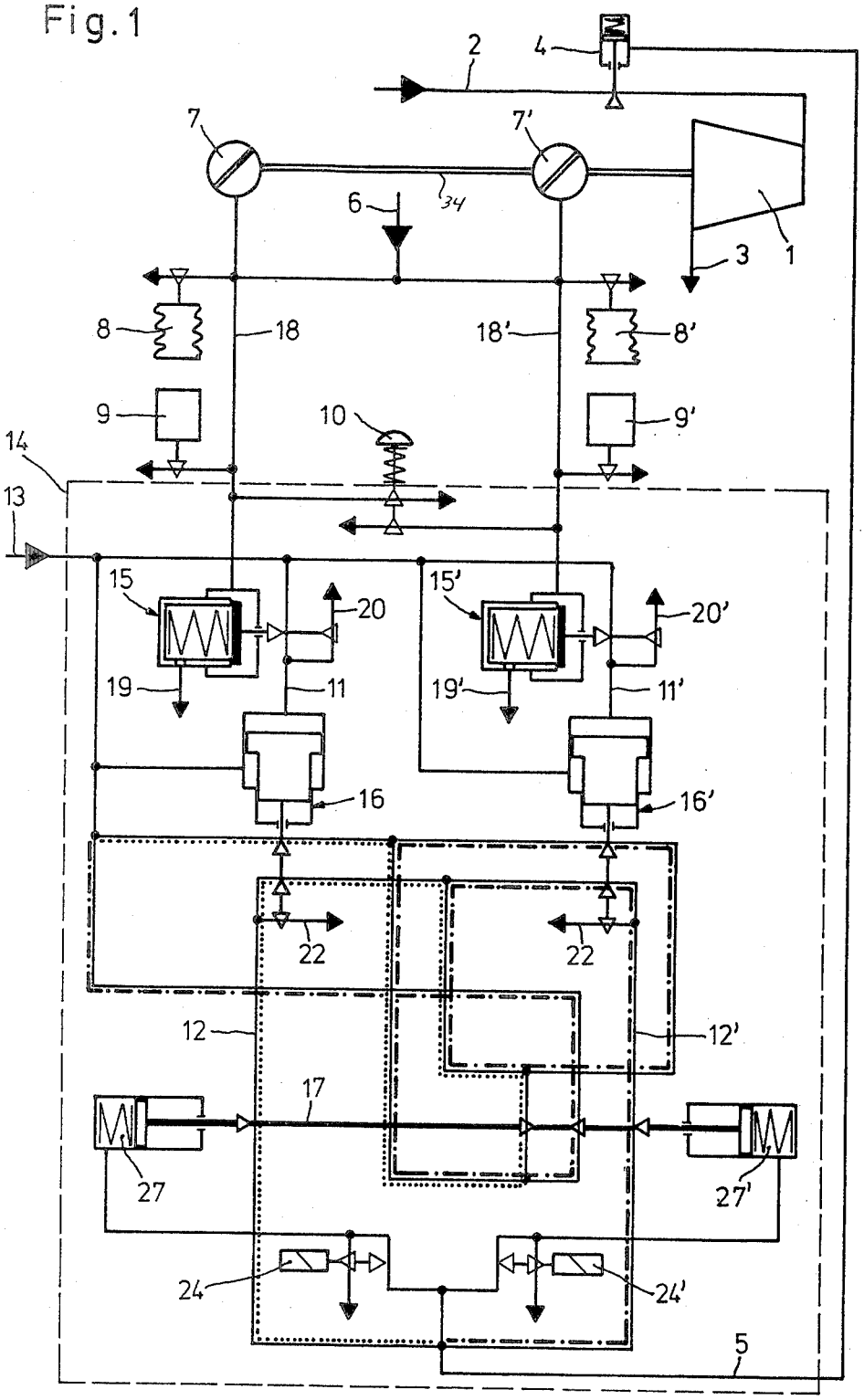
FIG. 1 is a schematic illustration of the safety system of the present invention for a steam turbine installation.

With reference to FIG. 1, a steam turbine 1 which can of course include more than one casing, is supplied with steam via a live steam line 2. Expanded steam leaves the turbine by way of an exhaust steam line 3. Located in the live steam line 2, and representative of a number of turbine stop valves, is a fast-acting valve 4 which is supplied via the common safety system 5.

The safety system is constructed on the hydraulic closed-circuit principle, i.e. operation of the installation is not possible in the de-pressurized condition. The system is divided into a low-pressure section and a high-pressure section. The low-pressure section is preferably an emergency-oil system, and the high-pressure section is preferably a control-fluid system. The safety devices needing to be tested during operation are located in the emergency-oil system 18, 18' which is supplied with oil from a lubricating-oil system 6 by way of orifices (not shown). The lubricating oil system is preferably at a pressure of 2.5 bar. The low pressure allows the safety devices contained in this system to be of a simple and reliable design.

The emergency-oil system 18, 18' has duplicate channels in a 1 out of 2 arrangement and incorporates various safety devices, all of which initiate hydraulic tripping. An overspeed trip 7, 7', is mounted in an intermediate shaft (not shown) and is driven by the turbine shaft 34. A vacuum trip 8, 8' provides protection against unacceptably high exhaust pressures. If the supply pressure of the lubricating oil, and hence of the emergency oil, is too low, a direct tripping results. It is possible to de-pressurize the emergency-oil systems 18, 18' via the turbine-trip solenoid valves 9, 9' or by means of a hand-operated electric switch 10. The emergency-oil systems 18, 18' can of course also be de-pressurized by means of various other devices (not shown) such as: a lubricating oil pressure monitor; a turbine monitor; a generator monitor; an automatic turbine control system; a fire protection monitor; and the like.

The control fluid system is also provided with duplicate channels, and includes intermediate safety systems 11, 11', principal safety systems 12, 12', and the already mentioned common safety system 5. These systems are supplied from the high-pressure hydraulic system 13, which is preferably set to a pressure of 40 bar. The entire control-fluid system, together with the associated devices referred to below, is contained within a control box 14 (indicated by a broken line). The pushbutton 10 is also contained within this control box 14.

The intermediate safety systems 11, 11' constitute a hydraulic link between tripping and reset relays 15, 15' and the feed and discharge amplifiers 16, 16'. The outputs from the latter comprise the principal safety systems 12, 12' which downstream from the separating relay 17 combine to form the common safety system 5.

The tripping and reset relays 15, 15' connect the two-channel emergency-oil system 18, 18' to the control-fluid system and coordinate the pressure between these two systems. If the pressure in one of the emergency-oil systems 18, 18' falls below a minimum value, the corresponding relay 15, 15' trips and the pressure in the safety systems 11, 11', 12, 12' and 5 drops to zero. These systems remain de-pressurized until they are restored to the normal operating condition by means of a reset command (not shown) to the relays 15, 15'.

The tripping and reset relays 15, 15' also ensure complete separation between the oil and the control fluid, which is especially advantageous if the high-pressure hydraulic system 13 is operated with a fire-resistant control fluid. When the relay 15, 15' trips, drains, 19, 19' in the emergency-oil system 18, 18' open, as do drains 20, 20' in the intermediate safety system 11, 11'. In this way the intermediate safety systems 11, 11' are thereby de-pressurized.

The feed and discharge amplifiers 16, 16' are connected so as to be fed in series. The amplifiers supply the quantity of hydraulic fluid required in the common safety system 5 to actuate the stop valves 4, and serve to de-pressurize the principal safety systems 12, 12' quickly in the event of a turbine trip. The amplifiers also serve to interrupt the supply of high-pressure hydraulic fluid 13 to the second amplifier 16', for example, if the first amplifier 16 receives a command to trip from the associated intermediate safety system 11.

The purpose of the separating relay 17 is to separate one channel, for instance the emergency-oil system 18, the intermediate safety system 11 and the principal safety system 12, from the common safety system 5 so that the safety devices and connecting devices 7, 8, 9, 15 and 16 in this channel can be tested. During testing, a second purpose of the separating relay 17 is to maintain the supply to the second operational channel from the high-pressure hydraulic system 13.

The separating relay 17 is actuated by solenoid valves 24, 24' and in this way the two channels of the emergency-oil system and of the control-fluid system can be tested separately during operation.

Figure 2:
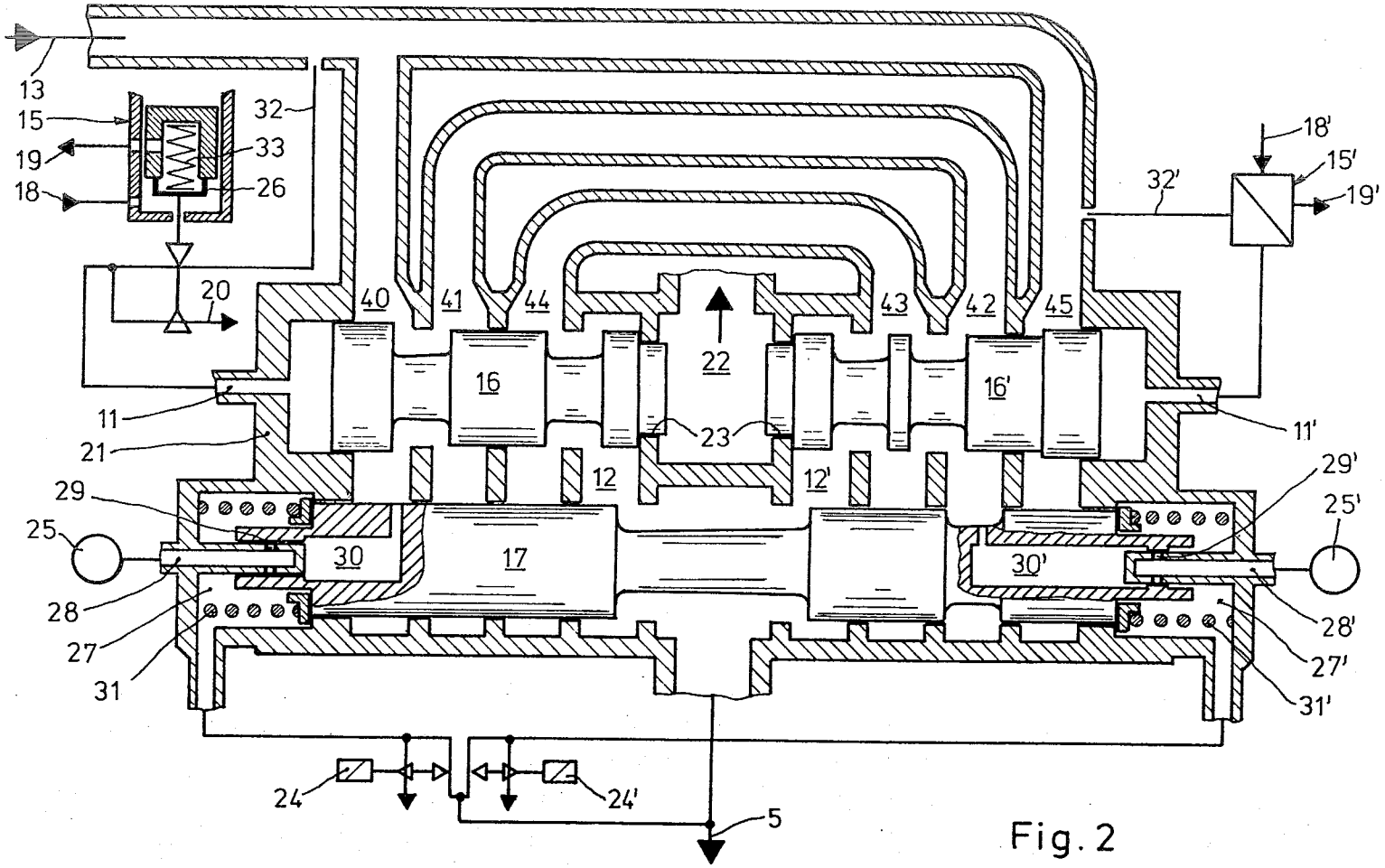
FIG. 2 is a cross-sectional view of the control box of the safety system with the various components illustrated in their operating position.

With reference now to FIG. 2, the amplifiers 16, 16' and the separating relay 17 are contained within a common housing 21 which is so constructed that during operation the same pressure exists in the adjoining chambers, which are separated by partitions. Accordingly, there is no leakage between the outside diameters of the amplifiers or of the separating relay and the holes in the housing. In this way, dirt deposits are slight and friction is minimal. Divisions between the discharge chamber 22 and the pressurized compartments (principal safety systems 12, 12') are in the form of seat-type valves 23, thereby reducing leakage to a minimum. The position of the separating relay 17 in the closed housing is detected unambiguously by means of pressure switches 25, 25'.

The safety system is designed to provide the following modes of operation: testing the safety devices with the turbine at standstill; starting the turbine; normal operation; tripping of the turbine; and, testing the safety devices during normal operation.

The operation of the present invention will now be explained in more detail with reference to FIGS. 2 and 4 for the last three operating modes stated above.

With reference to FIG. 2, the components 15, 15', 16, 16', 17, 24, 24' are illustrated in the position which they assume when the steam turbine installation is in normal operation. The prerequisite for normal operation is that the discharge areas of the safety devices 7, 7', 8, 8', 9, 9' and 10 in the emergency-oil system 18, 18' are closed. Disc valves 26, 26' in the tripping and reset relays 15, 15' are in the position shown, i.e. with drains 19, 19' of the emergency-oil systems and drains 20, 20' of the intermediate safety systems being closed. Consequently, the high-pressure hydraulic system 13 is free to supply fluid to the intermediate safety systems 11, 11'.

The pressure in the intermediate safety systems 11, 11' determines the positions of the feed and discharge amplifiers 16, 16', which close off the discharge chamber 22 by means of seat-type valves 23. The supply from the high-pressure hydraulic system 13 into the principal safety systems 12, 12' is unrestricted via a plurality of compartments 40, 41, 42, 43 and 44. The common safety system 5 is also pressurized via the open separating relay 17, and consequently the stop valve 4 (see FIG. 1) in the live steam line is opened. The hydraulic safety system operates digitally rather than in analog manner, i.e. the full pressure is either present or not present. Since the discharge areas of the solenoid valves 24, 24' are also closed, the spring compartments 27, 27' at the ends of the separating relay 17 are at full operating pressure. The position of the separating relay is indicated by the pressure switches 25, 25'.

Corresponding pressure spaces 28, 28' in a housing 21 are at zero pressure during normal operation because the position of the separating relay 17 does not allow the ports 29, 29' to connect with the high-pressure system via a pair of cavities 30, 30' in the separating relay 17. In the normal operating position the discharge chamber 22 is of course also de-pressurized.

Figure 3:
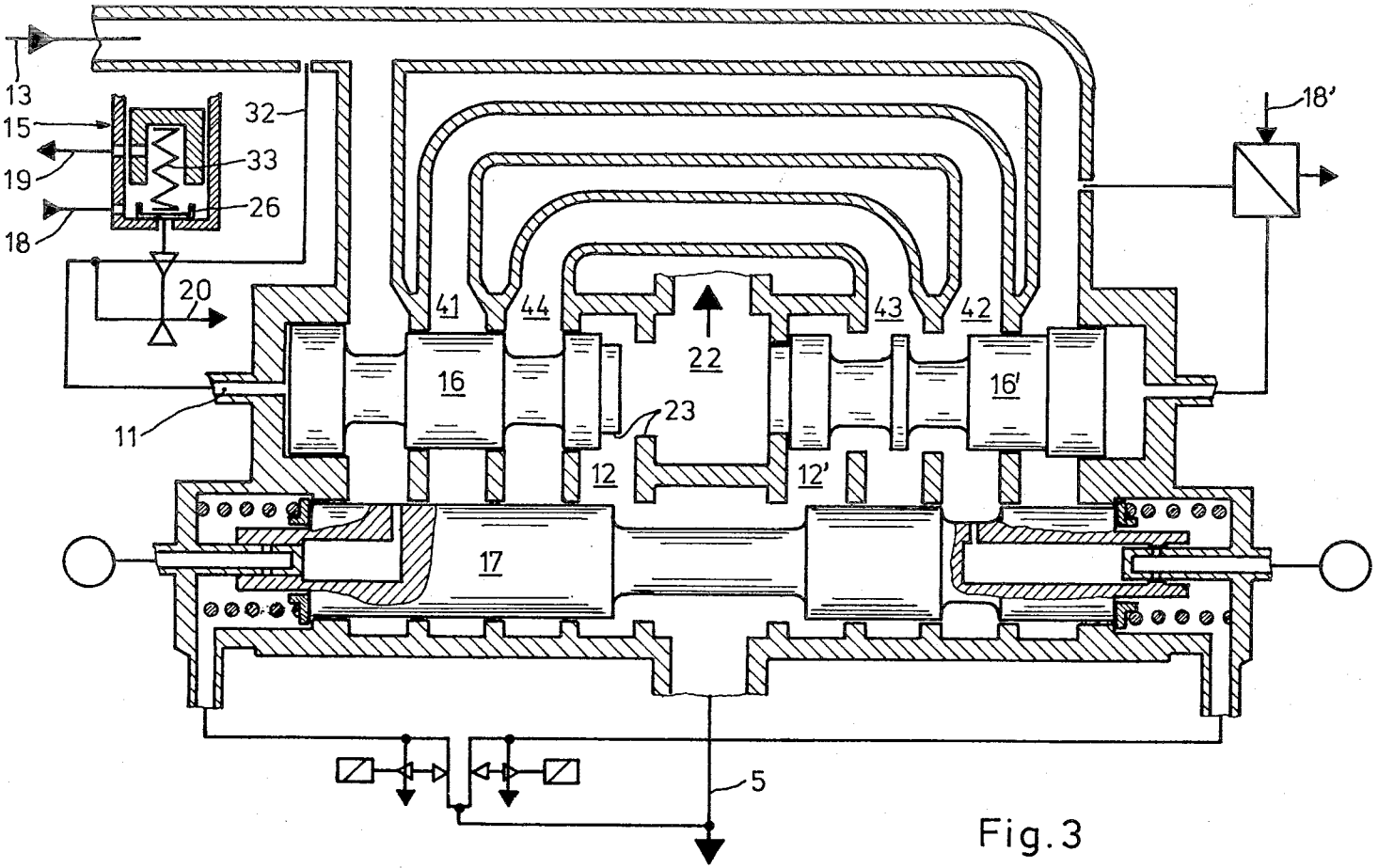
FIG. 3 is a cross-sectional view of the control box with the components illustrated in an arrangement corresponding to a turbine trip.

With reference now to FIG. 3, the components within the control box 14 are shown in the positions that they assume in the event of a turbine trip. The situation considered here is that one or more of the safety devices in one of the two emergency-oil systems 18, 18' responds. If the vacuum trip 8 responds, for example, the emergency-oil system 18 is de-pressurized. In the tripping and reset relay 15, the spring 33 opens the disc valve 26, whereupon the drain 19 is opened. The valves which are shown symbolically and actuated via the disc valve 26 close the supply line 32 and open the drain 20 of the intermediate safety system 11, which is consequently de-pressurized.

The feed and discharge amplifier 16, in the form of a differential piston, is moved to the left. This movement first cuts off the supply of fluid from the high-pressure hydraulic system 13 to the pressurized compartments 41 and 44. The seat valve 23 then opens to allow the control fluid to pass from the principal safety system 12 into the de-pressurized discharge chamber 22. Since the principal safety systems 12 and 12' are interlinked while the position of the separating relay 17 is unchanged, the pressure in pressure compartments 42 and 43 is also reduced to zero.

A noteworthy feature of this process is that the feed and discharge amplifier 16 has a positive land overlap, i.e. the pressure compartments are cut off from the supply before the discharge area opens. This arrangement ensures very fast response by the principal safety system 5, which is also linked with the principal safety systems 12, 12' by way of the unchanged position of separating relay 17. Because the principal safety systems 12, 12' are supplied in series via the feed and discharge amplifiers 16, 16', it is thus possible to ensure that the two channels are de-pressurized even when the turbine is tripped via only one channel of the emergency-oil system 18, 18'.

Figure 4:
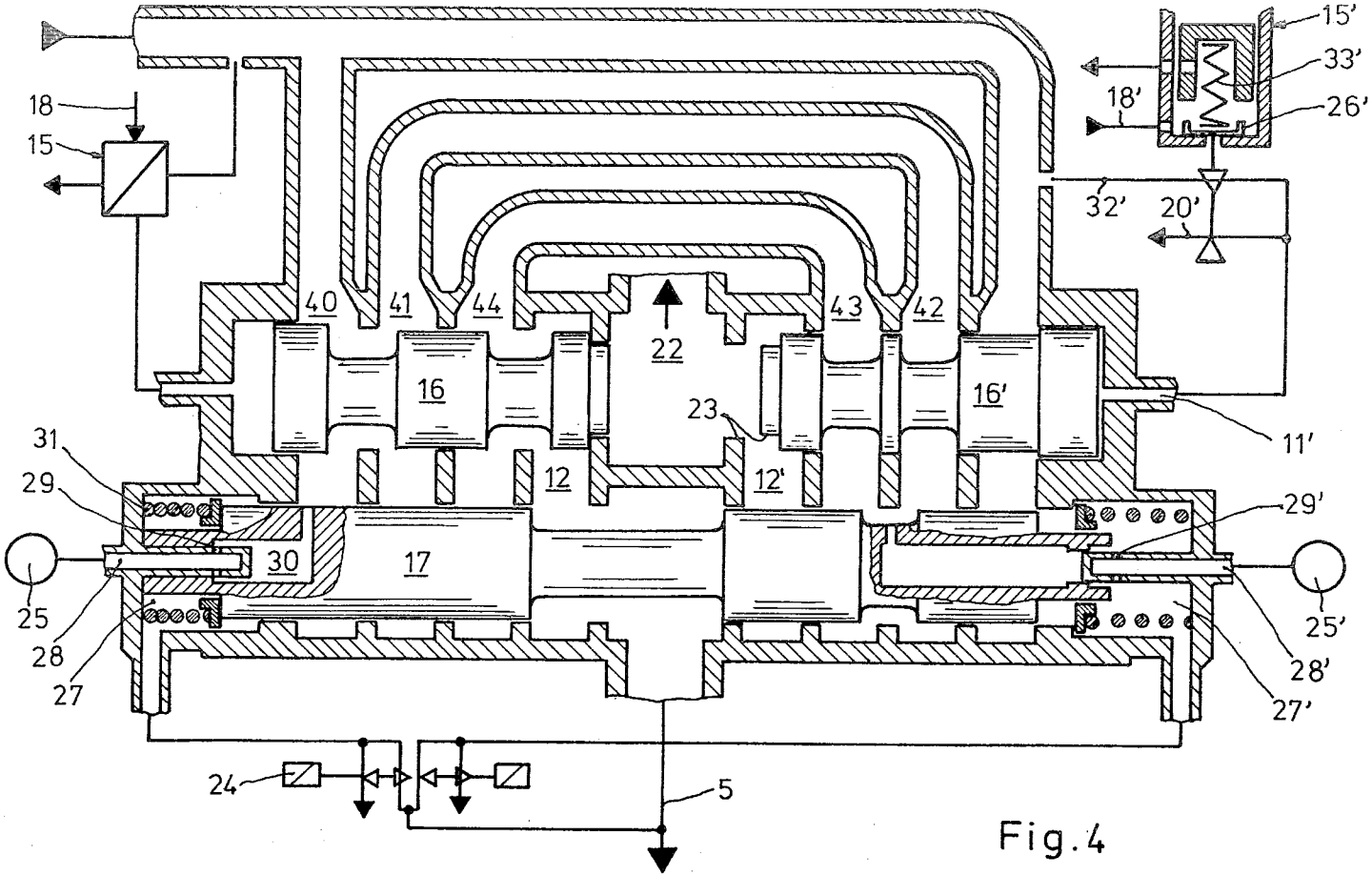
FIG. 4 is a cross-sectional view of the control box with the components illustrated in an arrangement corresponding to a functional check.

With reference now to FIG. 4, a very important situation results when the safety devices contained in the emergency-oil system 18, 18' are tested while the steam turbine installation is still in operation. To explain the operating principle it is assumed that the safety devices in the channel of the emergency-oil system 18' are to be tested. Testing is initiated by cutting off the supply to the spring compartment 27 by means of the solenoid valve 24 and at the same time the discharge area of solenoid valve 24 is opened. The pressure in spring compartment 27 is thus reduced to zero.

The operating pressure in the spring compartment 27' moves the separating relay 17 against the pressure of the spring 31 in the spring compartment 27. This movement of the separating relay 17 separates the principal safety system 12' from the common safety system 5. The appropriate position signal is then given by the pressure switches 25, 25', which now indicate the full operating pressure. This results because on the one hand, the pressure compartment 28 is now connected by way of ports 29 with the cavity 30 of the separating relay 17 and, on the other hand, because the pressure compartment 28' is connected with the spring compartment 27' via the port 29'.

The test then continues in that the corresponding safety device, the vacuum trip 8' in the emergency-oil system 18' for example, responds. Emergency-oil system 18' is thus depressurized and the intermediate safety system 11' is also de-pressurized by means of tripping and reset relay 15'.

These operations take place in the same manner as in the situation of turbine tripping described above. In this way, the feed and discharge amplifier 16' is moved to the right, the positive land overlap causes the principal safety system 12' to be cut off from the supply from the pressure compartment 43, and only then does the seat-type valve 23 on the amplifier 16' permit access to the discharge chamber 22.

In this way it is possible to check that all of the components of a channel, i.e. not only the safety devices but also the appropriate tripping and reset relays and the feed and discharge amplifier 16', are operating correctly. This is made possible by the fact that additional lands on the separating relay 17 interrupt the series connection of the feed and discharge amplifiers 16, 16'. During such a test, the supply to the common safety system 5 is maintained by way of the principal safety system 12 and the pressure compartments 44, 43, 42, 41 and 40.

With reference again to FIG. 1, a dotted line indicates the path that the high-pressure hydraulic fluid has to take during the described testing of systems 18', 11' and 12' in order to be applied to the common safety system 5. The positions of the various valves correspond here not to the test position, but to the normal operating position.

The converse case, i.e. the testing of systems 18, 11 and 12, is indicated by the chain-dotted line in the high-pressure section. In this instance, the supply is not, as in all of the cases described hitherto, via the compartment 40 and feed and discharge amplifier 16 (which is now in the extreme left-hand position), but is instead via the chamber 45. Since the separating relay 17 has now moved into the spring compartment 27', the control fluid flows through the compartments 42 and 43 to the common safety system 5. In this situation also, therefore, the amplifiers 16, 16' are not connected in series.

Finally, the situation is described wherein a turbine trip occurs in the emergency-oil system 18, for example, while the operation of systems 18', 11' and 12' is being tested. It is assumed that the components are in the position shown in FIG. 4. From the description in relation to FIG. 2, which shows the reaction of the components to a turbine trip, it is evident that the intermediate safety system 11 is de-pressurized. The supply from the compartment 40 is interrupted by the movement of the amplifier 16 to the left (not shown). The amplifier 16 clears an access from the principal system 12 to the discharge chamber 22. There is no longer an incoming flow through compartments 41, 42, 43 and 44 and the pressure in the common system 5 drops to zero.

It is to be understood that the form of embodiment of the present invention which has been described above has been given by way of a purely indicative and in no way limiting example. Other modifications may readily be made by one skilled in the art without thereby departing from the scope of the invention.

What is claimed is:

1. A safety system for a steam turbine installation, comprising:

stop valve means for selectively stopping operation of the steam turbine;

first safety means for sensing operating conditions of the steam turbine installation, the first safety means having at least first and second channel portions, each channel portion including a plurality of safety devices;

second safety means for controlling the stop valve means in response to the first safety means, the second safety means having at least first and second channel portions, each channel portion of the second safety means corresponding to one of the channel portions of the first safety means; and separating relay means for permitting testing of the safety devices of each channel of the first and second safety means during operation of the steam turbine installation.

2. The safety system of claim 1 wherein:

the first safety means includes a relatively low pressure fluid circuit, and the second safety means includes a relatively high pressure fluid circuit.

3. The safety system of claim 1, wherein:

the second safety means includes, intermediate safety circuit means for receiving signals from the safety devices of the first safety means, common safety circuit means for selectively actuating the stop valve means, and principal safety circuit means for transmitting signals from the intermediate safety circuit means to the common safety means.

4. The safety system of claim 3, wherein:

the intermediate safety circuit means has at least first and second channel portions, each channel portion of the intermediate safety circuit means corresponding to one of the channel portions of the first safety means; and the principal safety circuit means has at least first and second channel portions, each channel portion of the principal safety circuit means corresponding to one of the channel portions of the intermediate safety circuit means.

5. The safety system of claim 4, wherein:

the common safety circuit means has only one channel portion.

6. The safety system of claim 3 further comprising:

tripping and reset relay means for transmitting the signals from the first safety system means to the intermediate safety circuit means.

7. The safety system of claim 6 further comprising:

feed and discharge amplifier means for transmitting the signals from the intermediate safety circuit means to the principal safety circuit means and for separating the intermediate safety circuit means from the principal circuit means.

8. The safety system of claim 7 wherein:

the separating relay means permits a selective connection of the principal safety circuit means to the common safety circuit means during testing.

9. The safety system of claim 7 wherein:

the feed and discharge amplifier means includes at least first and second feed and discharge amplifiers normally connected in series, the series connection of the amplifiers being interrupted during testing of the safety devices of each channel of the first safety means.

10. The safety system of claim 2 wherein a working fluid of the relatively low pressure fluid circuit is lubricating oil with a pressure of about 2.5 bar.

11. The safety system of claim 2 wherein:

a working fluid of the relatively high pressure fluid circuit is a fire-resistant control fluid with a pressure of about 40 bar.

12. The safety system of claim 8 wherein:

the tripping and reset relay means, the intermediate safety circuit means, the feed and discharge amplifier means, the principal safety system means, the separating relay means and the common safety circuit means are all substantially contained within a common control box.

13. The safety system of claim 8 wherein:

the feed and discharge amplifier means and the separating relay means are substantially contained in a common housing.

14. The safety system of claim 9 wherein:

the feed and discharge amplifiers each have a positive land overlap.

* * * * *